US005702730A

United States Patent [19]

Reifenhäuser et al.

[11] Patent Number: 5,702,730

[45] Date of Patent: Dec. 30, 1997

[54] APPARATUS FOR MAKING A CONTINUOUS THERMOPLASTIC FLEECE

[75] Inventors: Hans Reifenhäuser; Michael Baumeister, both of Troisdorf, Germany

[73] Assignee: Reifenhauser GmbH & Co. Maschinenfabrik, Troisdorf, Germany

[21] Appl. No.: 651,278

[22] Filed: May 22, 1996

[30] Foreign Application Priority Data

May 26, 1995 [DE] Germany ..... 195 18 895.0

[51] Int. Cl.[6] ..... B29C 47/34

[52] U.S. Cl. ..... 425/72.2; 425/88; 425/213

[58] Field of Search ..... 425/88, 200, 186, 425/201, 192 S, 213, 72.2; 264/176 R, 210.8; 52/79.2; 182/48

[56] References Cited

U.S. PATENT DOCUMENTS

| | | | |
|---|---|---|---|
| 3,517,412 | 6/1970 | Swanson et al. | 425/192 S |
| 3,881,850 | 5/1975 | Stockbridge | 425/72.2 |
| 3,902,833 | 9/1975 | Matovinovic | 425/72.2 |
| 4,074,476 | 2/1978 | Ordorika | 52/79.2 |
| 4,340,563 | 7/1982 | Appel . | |
| 4,602,697 | 7/1986 | Aanensen | 182/48 |
| 4,648,825 | 3/1987 | Heil et al. | 425/186 |
| 4,820,142 | 4/1989 | Balk . | |
| 5,032,329 | 7/1991 | Reifenhauser . | |

FOREIGN PATENT DOCUMENTS

| | | |
|---|---|---|
| 33 43 714 A1 | 7/1984 | Germany . |
| 37 13 862 C2 | 11/1988 | Germany . |
| 40 14 414 A1 | 7/1991 | Germany . |

OTHER PUBLICATIONS

Article "Hoechst Celanese Mexican Plant Expands Polyester in Carpet" of Textile World.

*Primary Examiner*—Jay H. Woo
*Assistant Examiner*—Minh-Chau T. Pham
*Attorney, Agent, or Firm*—Herbert Dubno; Andrew Wilford

[57] ABSTRACT

An apparatus for making a plastic filament web has in a vertical stack starting from the top an extruder releasably mounted on a platform, connected to a spinneret, and supplying molten plastic thereto for formation of plastic streams, a blowing unit directly beneath the spinneret cooling the streams and forming them into plastic filaments, a stretching gap directly beneath the blowing unit stretching the plastic filaments, a diffuser shaft directly beneath the stretching gap looping the stretched plastic filaments, and a foraminous conveyor directly beneath the diffuser shape receiving the looped and stretched filaments as a fleece which it transports horizontally out of the apparatus. A lowermost housing containing the conveyor sits directly on a stationary support surface and has an upper surface. An uppermost housing spaced above the lowermost housing supporting the extruder platform contains at least the spinneret and has a lower surface. A plurality of intermediate housings in a stack between the lowermost and uppermost housings contain the blowing unit, the stretching gap, and the diffuser shaft and each have a lower and an upper surface. Each lower surface directly engages and fits complementarily to the upper surface of the underlying housing with the intermediate and uppermost housings substantially wholly supported on the underlying housings and on the lowermost housing and the housings forming a tower supporting the platform.

10 Claims, 5 Drawing Sheets

APPARATUS FOR MAKING A CONTINUOUS THERMOPLASTIC FLEECE

FIELD OF THE INVENTION

The present invention relates to an apparatus for making a fleece. More particularly this invention concerns a method of making such an apparatus.

BACKGROUND OF THE INVENTION

As described in commonly owned U.S. Pat. Nos. 4,820,142 and 5,032,329 and U.S. Pat. No. 4,340,563 an apparatus for making a continuous thermoplastic fleece comprises a spinning nozzle system or spinneret, a blowing or cooling shaft, a stretching gap, a diffuser shaft, and a continuously moving filament-receiving conveyor. Process air is fed to the cooling shaft and is drawn out through the mat-receiving conveyor. The cooling shaft has a shaft wall provided with a plurality of air orifices and the process air required for cooling is introduced through the air orifices to provide an air flow in the shaft that is at least partially drawable through the mat-forming conveyor. With this equipment molten hot plastic is received from the extruder by the spinnerets which extrude it as thin molten streams and these streams are cooled and cured in the blowing or cooling shaft to produce stretchy but relatively thick filaments. These filaments are then stretched in the gap and then blown about in the diffuser shaft to form them into loops, and finally they deposit as a fleece-forming mat on the continuously moving conveyor. The process takes place vertically, with the spinnerets emitting the molten streams downward and the various other stages succeeding each other one below the next, with the conveyor being at the bottom of the stack.

As a rule a multistory three-dimensional framework is built having five or six levels. Once the framework is complete a crane is used to fit each level with a respective stage of the apparatus. The extruder is carried at a platform at the top of the framework where the spinnerets are provided connected releasably to the extruder and the conveyor is at the bottom of the framework, normally supported directly on a floor surface, or shimmed up to closely engage the overlying diffuser shaft. Each stage is fitted to the frame at its level and the various stages are then fitted vertically to one another with spacers, seals, and shields to form a laterally closed treatment space.

Setting up such an apparatus is therefore extremely difficult and, at best, there are usually some leaks that take careful patching or that decrease the reliability and operating efficiency of the system.

OBJECTS OF THE INVENTION

It is therefore an object of the present invention to provide an improved apparatus for making a plastic fleece.

Another object is the provision of such an improved apparatus for making a plastic fleece which overcomes the above-given disadvantages, that is which is simple and easy to assemble and that will remain air tight even after long service.

Yet another object is to provide an improved method of making such an apparatus.

SUMMARY OF THE INVENTION

The instant invention is an improvement on an apparatus for making a plastic filament web and having in a vertical stack starting from the top an extruder releasably mounted on a platform, connected to a spinneret, and supplying molten plastic thereto for formation of downwardly moving plastic streams, a blowing unit directly beneath the spinneret cooling the streams and forming them into downwardly moving plastic filaments, a stretching gap directly beneath the blowing unit stretching the plastic filaments, a diffuser shaft directly beneath the stretching gap looping the stretched plastic filaments, and a foraminous conveyor directly beneath the diffuser shape receiving the looped and stretched filaments as a fleece and transporting the fleece horizontally out of the apparatus. According to the invention a lowermost housing containing the conveyor is adapted to sit directly on a stationary support surface and has an upper surface. An uppermost housing spaced above the lowermost housing supporting the extruder platform contains at least the spinneret and has a lower surface. A plurality of intermediate housings stacked one atop the other between the lowermost and uppermost housings contain the blowing unit, the stretching gap, and the diffuser shaft and each have a lower surface and an upper surface. Each lower surface directly engages and fits complementarily to the upper surface of the underlying housing with the intermediate and uppermost housings substantially wholly supported on the underlying housings and on the lowermost housing and the housings forming a self-supporting tower supporting the platform.

A self-supporting tower is a structure which can stand on its own on a base surface with no auxiliary support. The housings themselves are relatively fixed components that together form an integral structure whose parts cannot normally move relative to one another. According to the invention these housings are flanged and bolted together so as to eliminate spacers, shims, seals, and the like used in the prior art fleece-making apparatuses. Since the various units or stages of the apparatus are each solidly mounted in a respective housing, the apparatus is assembled simply by stacking up and securing together these housings. No separate frame into which the various stages are fitted is needed. Thus an apparatus according to the invention can be set up in a fraction the time of a prior-art such apparatus.

According to the invention the lowermost housing is constructed to support and carry the intermediate and uppermost housings and to support the extruder and platform. The housings are made of sheet metal.

The tower according to the invention can be provided with gangways adapted to support service personnel. In addition a framework can be provided surrounding the tower and carrying the gangways.

The diffuser shaft projects from one of the intermediate housings into the lowermost housing.

In a web-making apparatus the diffuser shaft, the stretching gap, the blowing unit, and the spinneret are each mounted in a respective one of the housings for a total of four housings. Alternately the diffuser shaft, the stretching gap, the blowing unit, and the spinneret are mounted in a single one of the housings for a total of three housings. The diffuser shaft is removably mounted in its housing since it needs frequent service and the stretching gap projects downward from its housing into the housing of the diffuser shaft. Furthermore fasteners are provided engaged between the uppermost and intermediate housings and the underlying housings for securing the housings vertically together.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
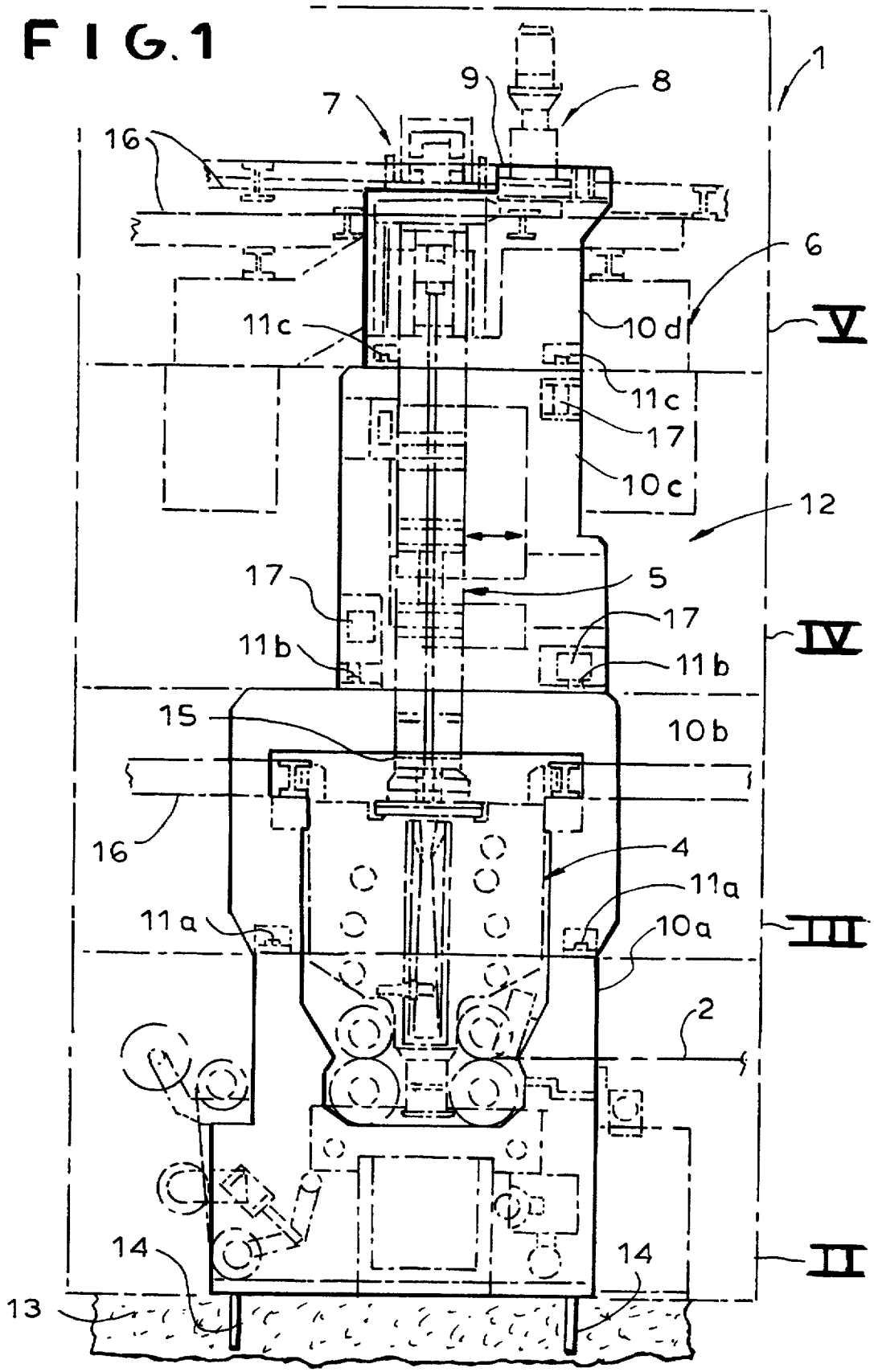
FIG. 1 is a largely schematic side view of the apparatus according to the invention.
Figure 2:
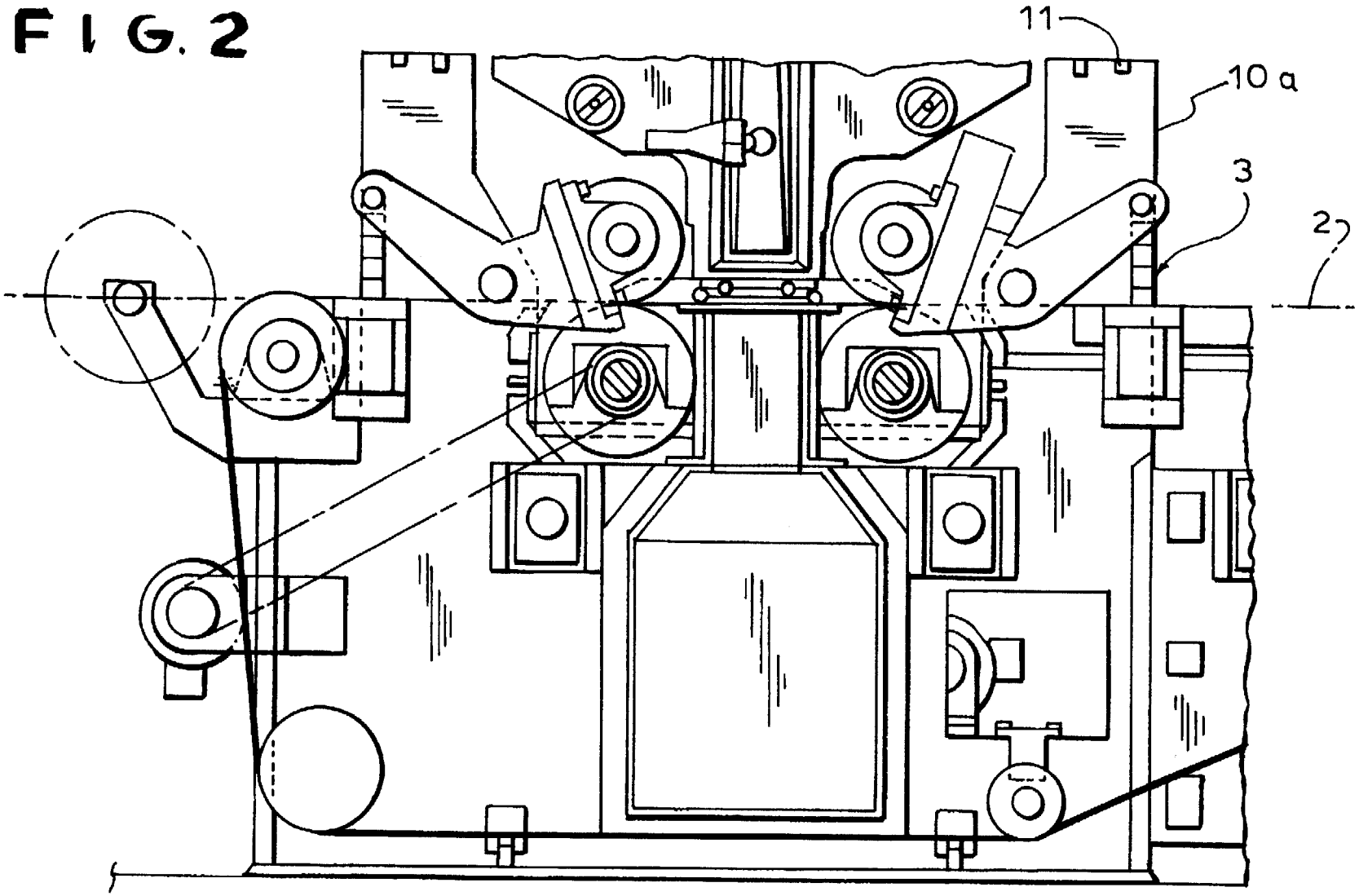
FIGS. 2, 3, 4, and 5 are larger-scale views of the details indicated at respective dot-dash boxes II, III, IV, and V of FIG. 1.

As seen in FIG. 1 an apparatus 1 for making a plastic-filament web 2 basically comprises a foraminous conveyor-belt transporter 3, a diffuser shaft 4 immediately thereabove, a stretching gap 5 immediately thereabove, a blowing/cooling unit 6 immediately thereabove, and a spinneret 7 immediately thereabove and releasably connected to an extruder 8 itself carried on a platform 9. As is standard in such an apparatus the extruder 8 feeds molten hot plastic to the spinneret unit 7 which extrudes the plastic as thin molten streams which are cooled and cured in the blowing or cooling unit 6 to produce stretchy but relatively thick filaments. These filaments are then stretched in the gap 5 and then blown about in the diffuser shaft 4 to form them into loops, and finally they deposit as a fleece-forming mat 2 on the continuously moving conveyor 3 which transports the mat 2 horizontally out of the apparatus 1.

According to the invention the conveyor 2 is held in a lowermost or first housing 10*a* seated directly on a floor 13. The diffuser shaft 4 is largely contained in another housing 10*b* having a bottom surface complementary to and fitting on a top surface of the housing 10*a* and secured thereto by fasteners 11*a* so that the entire weight of the housing 10*b* is carried by the housing 10*a*. In turn the stretching gap 5 is held in another housing 10*c* having a bottom surface complementary to and fitting on a top surface of the housing 10*b* and secured thereto by fasteners 11*b* so that entire weight of the housing 10*c* is carried by the housings 10*a* and 10*b*. The blowing unit 6 and spinneret 7 are carried on a housing 10*d* that supports the platform 9 of the extruder 8, with fasteners 11*c* securing the bottom of the housing 10*d* to the top of the housing 10*c*. The housings 10*a*, 10*b*, 10*c*, and 10*d* together form a stable load-bearing tower 12 capable of carrying the platform 9.

The lowermost housing 10*a* has internal support members extending from its top surface to the floor 13 to carry the overlying load and shown at 14 extending into the floor 13. This housing 10*a* is particularly robust to support all the overlying equipment.

Figure 3:
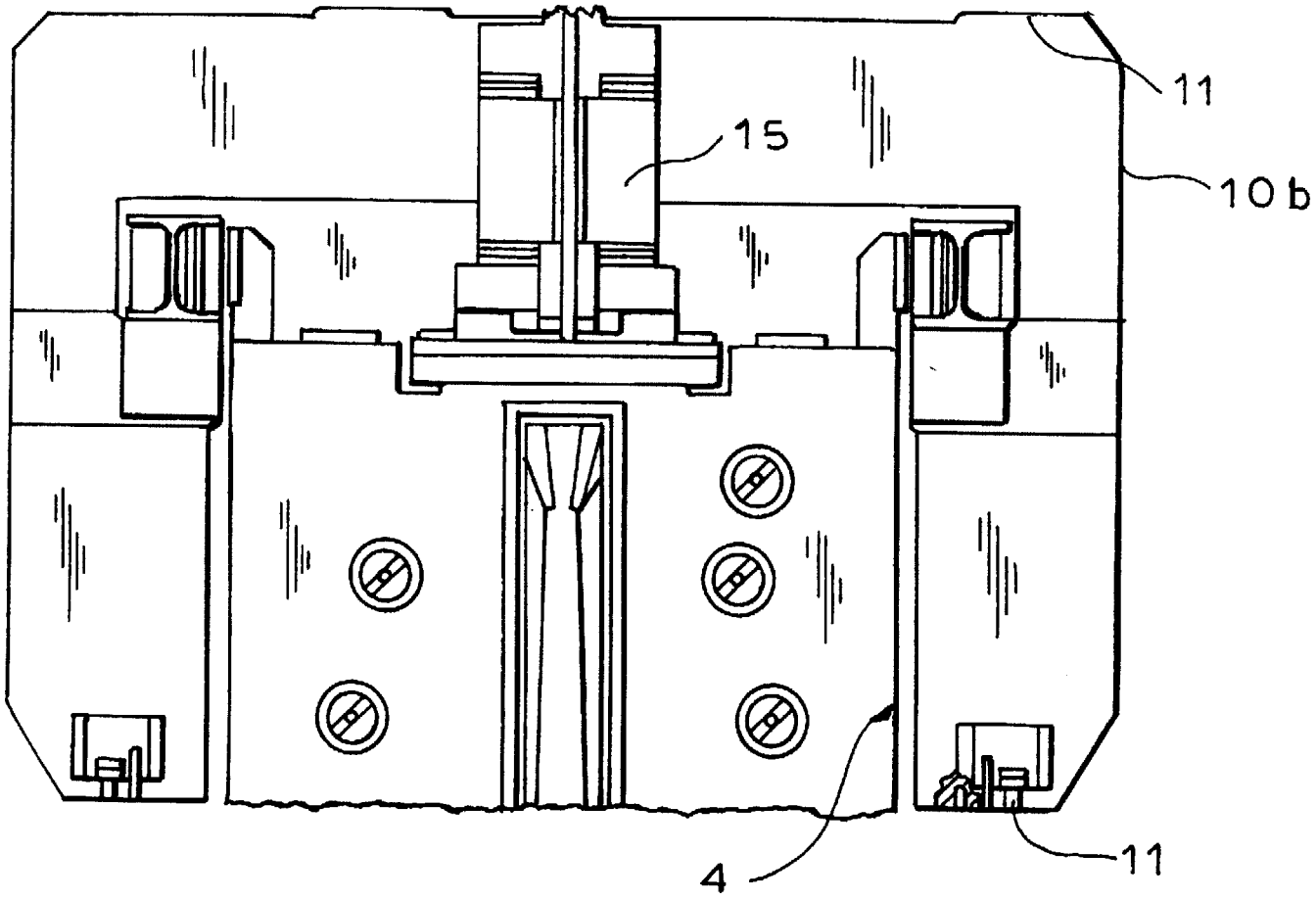
Figure 4:
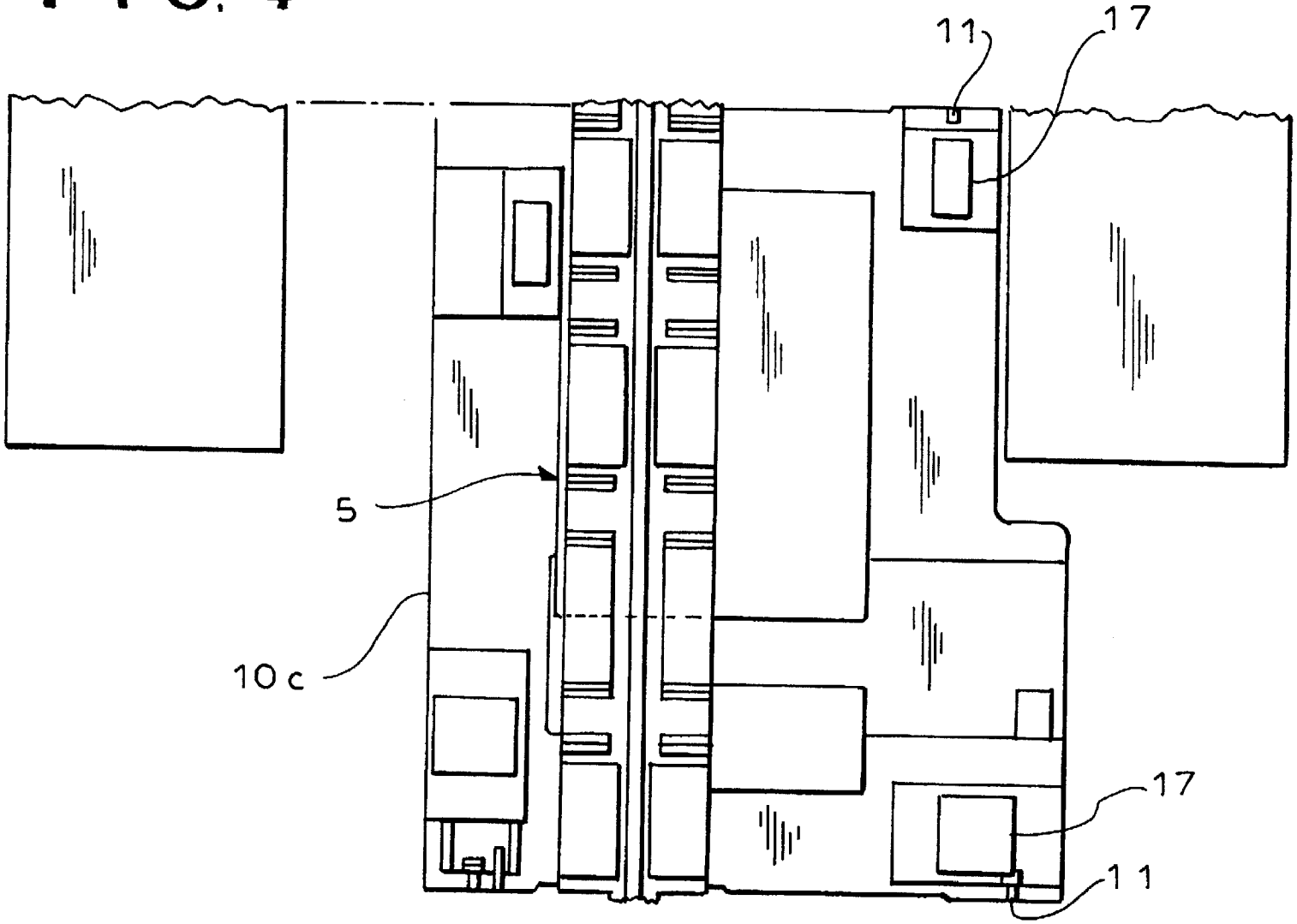
Figure 5:
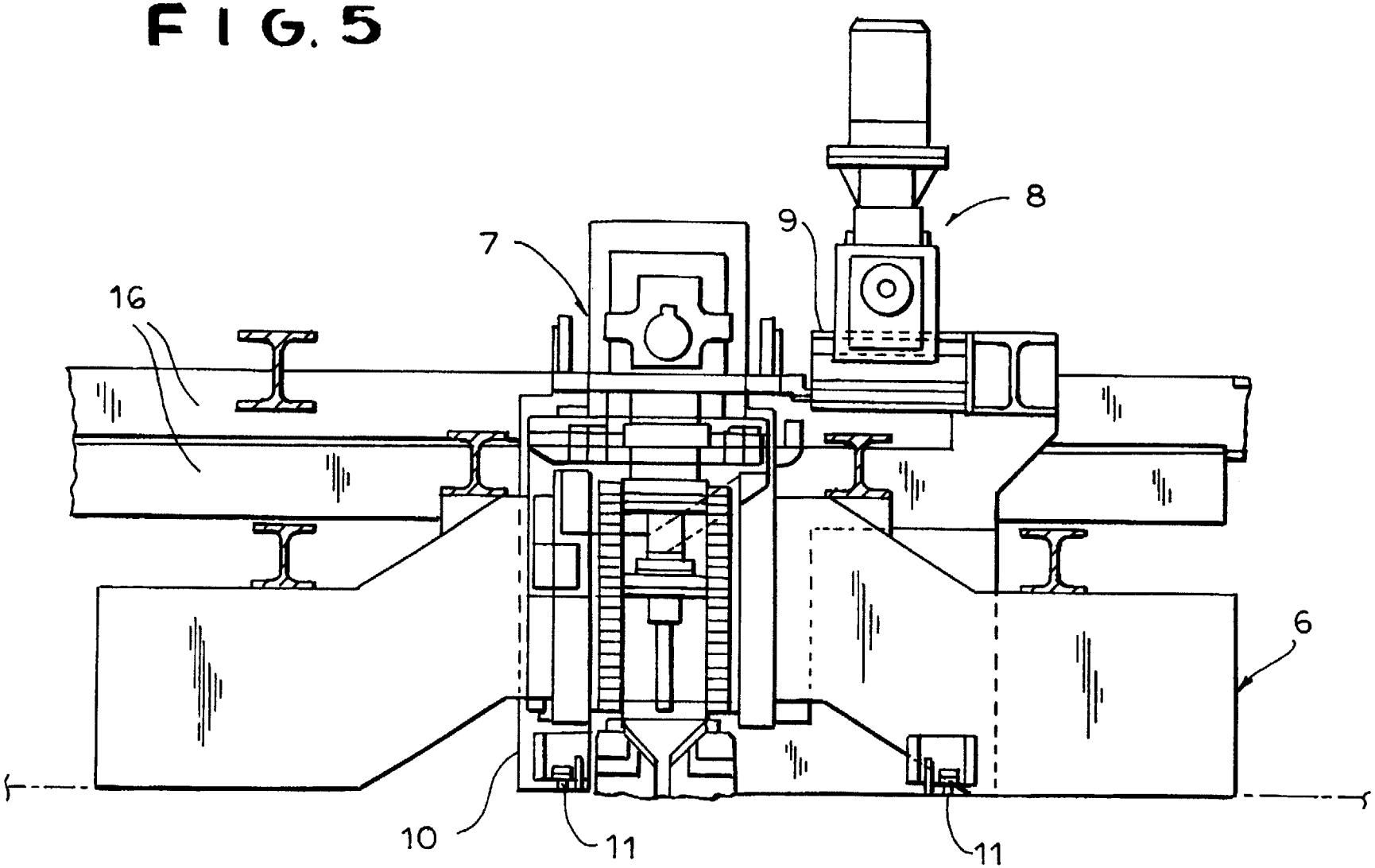

FIGS. 1 and 3 show how stretching gap 5 has a lower part 15 that extends down into the housing 10*b* of the diffuser shaft 4.

The housing modules 10*a* through 10*d* are made of sheet-steel frames. The tower 12 may carry a gangway 16 so that service and operating personnel have access to the equipment. A separate frame may be provided for carrying such a gangway 16. In addition the structure shown in FIG. 1 may be a single part of a long production line of such structures extending perpendicular to the view plane, with the individual modules joined together by traverses 17.

We claim:

1. In an apparatus for making a plastic filament web and having arranged in a vertical stack starting from the top an extruder releasably mounted on a platform, connected to a spinneret, and supplying molten plastic thereto for formation of downwardly moving plastic streams, a blowing unit directly beneath the spinneret cooling the streams and forming them into downwardly moving plastic filaments, a stretching gap directly beneath the blowing unit stretching the plastic filaments, a diffuser shaft directly beneath the stretching gap looping the stretched plastic filaments, and a foraminous conveyor directly beneath the diffuser shape receiving the looped and stretched filaments as a fleece and transporting the fleece horizontally out of the apparatus, the improvement comprising:

a lowermost housing containing the conveyor, adapted to sit directly on a stationary support surface, and having an upper surface;

an uppermost housing spaced above the lowermost housing, supporting the extruder platform, containing at least the spinneret, and having a lower surface;

a plurality of intermediate housings stacked one atop the other between the lowermost and uppermost housings, containing the blowing unit, the stretching gap, and the diffuser shaft and each having a lower surface and an upper surface, each lower surface directly engaging and fitting complementarily to the upper surface of the underlying housing, the intermediate and uppermost housings being substantially wholly supported on the underlying housings and forming therewith a self-supporting tower supporting the platform; and support members in the lowermost housing extending from the upper surface of the lowermost housing into the stationary support surface and supporting the intermediate and uppermost housings on the stationary support surface.

2. The web-making apparatus defined in claim 1 wherein the housings are made of sheet metal.

3. The web-making apparatus defined in claim 1 wherein the tower is provided with gangways adapted to support service personnel.

4. The web-making apparatus defined in claim 3, further comprising a framework surrounding the tower and carrying the gangways.

5. The web-making apparatus defined in claim 1 wherein the diffuser shaft projects from one of the intermediate housings into the lowermost housing.

6. The web-making apparatus defined in claim 1, further comprising means including fasteners engaged between the uppermost and intermediate housings and the underlying housings for securing the housings vertically together.

7. The web-making apparatus defined in claim 1 wherein the diffuser shaft, the stretching gap, the blowing unit, and the spinneret are each mounted in a respective one of the housings.

8. The web-making apparatus defined in claim 1 wherein the diffuser shaft, the stretching gap, the blowing unit, and the spinneret are mounted in a single one of the housings.

9. The web-making apparatus defined in claim 1 wherein the diffuser shaft is removably mounted in its housing.

10. The web-making apparatus defined in claim 1 wherein the stretching gap projects downward from its housing into the housing of the diffuser shaft.

* * * * *